United States Patent [19]

Riegler

[11] Patent Number: 4,614,484

[45] Date of Patent: Sep. 30, 1986

[54] ROTARY SCREW COMPRESSOR WITH SPECIFIC TOOTH PROFILE

[75] Inventor: Gerold Riegler, Schweinfurt, Fed. Rep. of Germany

[73] Assignee: Boge Kompressoren Otto Boge GmbH & Co. KG, Bielefled, Fed. Rep. of Germany

[21] Appl. No.: 678,717

[22] Filed: Dec. 6, 1984

[30] Foreign Application Priority Data

Dec. 14, 1983 [AT] Austria ..... 4348/83

[51] Int. Cl.[4] ..... F04C 18/00

[52] U.S. Cl. ..... 418/201

[58] Field of Search ..... 418/150, 201, 178, 179, 418/206, 150, 201

[56] References Cited

U.S. PATENT DOCUMENTS

| | | | |
|---|---|---|---|
| 3,666,384 | 5/1972 | Amosov | 418/201 |
| 3,865,523 | 2/1975 | Baehr | 418/201 |
| 3,867,076 | 2/1975 | Spindler | 418/201 |
| 3,881,849 | 5/1975 | Commarmot | 418/152 |
| 4,028,026 | 6/1977 | Menssen | 418/201 |
| 4,140,445 | 2/1979 | Schibbye | 418/201 |
| 4,210,410 | 7/1980 | Ohtani | 418/201 |
| 4,445,831 | 5/1984 | Ingalls | 418/201 |

FOREIGN PATENT DOCUMENTS

| | | | |
|---|---|---|---|
| 250118 | 3/1964 | Australia | 418/201 |
| 238362 | 2/1965 | Austria . | |
| 2639870 | 5/1977 | Fed. Rep. of Germany . | |
| 2735670 | 3/1978 | Fed. Rep. of Germany . | |
| 2234777 | 3/1980 | Fed. Rep. of Germany . | |
| 3140107 | 4/1983 | Fed. Rep. of Germany . | |
| 254986 | 7/1926 | United Kingdom | 418/201 |

*Primary Examiner*—Leonard E. Smith
*Assistant Examiner*—Jane E. Obee
*Attorney, Agent, or Firm*—Brumbaugh, Graves, Donohue & Raymond

[57] ABSTRACT

A parallel-and-external-axis rotary piston compressor includes a housing provided with an inlet and a discharge port and at least two rotors as the main and gate rotors. These are edged with screw-likely extended tooth spaces and are arranged to interengage and with their axes parallel. The tooth profiles of the main rotor are designed to be substantially convex and outside of the pitch circle and the tooth flanks of the gate rotor are designed to be substantially concave and within the pitch circle. In order to guarantee a simple and low-cost manufacture, a robust design and small clearances both for the main and the gate rotors, with a low wear during operation, both flanks of the main rotor teeth are surfaces conforming to the envelope of a helical plane inclined with respect to the axis of the helix and which follow a constant curve course continuously from the tooth root to the tooth crest.

12 Claims, 8 Drawing Figures

ROTARY SCREW COMPRESSOR WITH SPECIFIC TOOTH PROFILE

BACKGROUND OF THE INVENTION

The invention relates to a parallel-and-external-axis screw-type rotary piston compressor comprising a housing provided with inlet and discharge ports and at least two rotors as the main and gate rotors, which are edged with helically extended tooth spaces and are arranged to interengage and with their axes parallel to each other. The tooth profiles of the main rotor are designed to be substantially convex and outside of the pitch circle and the tooth flanks of the gate rotor being designed to be substantially concave and within the pitch circle.

Although screw-type compressors have been built for about thirty years, it was only in the past fifteen years that they have been widely used as series machines. In terms of quantities, it is primarily the smaller air or refrigerant compressors cooled by injected oil that constitute the major portion of the world production of screw-type compressors.

Screw-type compressors mostly are two-shaft rotary piston compressors. They operate in a similar manner as the known piston compressors, according to the principle of displacement. In the case of screw-type compressors, the operation spaces are constituted by the tooth spaces of two interengaging rotors with helical gears, which are revolving in a housing closely surrounding the rotors.

On rotating the compressor rotor, which is provided with a special toothing, the tooth space volume of a pair of tooth spaces that exists between the end face of the rotor and the lines of contact of the rotor teeth gradually declines from a maximum value to zero. The gas to be conveyed, which is trapped between the tooth spaces and the bores of the housing, thus is constantly compressed and is finally displaced out to the pressure pipe through a dislodge port provided in the compressor housing. Since there are no mass forces, screw-type compressors can operate at high speeds and thus can be constructed to be small and light.

A substantial disadvantage of screw-type compressors is the imperfect sealing of the operation spaces between the tooth crests and the compressor housing, between the rotor end faces and the end lids of the housing as well as at the rotor mesh. Due to the internal leakage, that is, the amount of gas flowing off through the leakage gaps of the operation space, the efficiency of the compressor is considerably deteriorated, the loss of effeciency depending on the shape of the toothing chosen as well as on the production accuracy achieved.

In order to keep these internal leakage amounts small, hydraulic oil is injected into the tooth spaces during the compression procedure with most screw-type compressors, the amount of oil injected being about 6 to 15 $l/m^3$ of intake air. The oil is most finely dispersed because of the high rotor speeds, thus forming a two-phase mixture with the air, whereby it is possible to reach a better sealing of the leakage gaps and thus a reduction of the leakage-gas amounts. On the other hand, the addition of oil results in increases internal losses within the compressor, because of oil specific effects such as splash losses and incompressibility adversely affects the efficiency of the compressor and restricts the amount of oil per intake-air amount.

A further significant disadvantage of the screw-type compressors available on the market results from the complexity of the special toothing used, by which it is aimed at reaching particularly large compression chambers with leakage gaps as small as possible. A tooth flank profile of this type is known, for instance, from German Offenlegungsschriften Nos. 26 39 870 and 27 35 670. There, tooth flank profiles for helical rotors are described, which, in the end cross section, are comprised of a plurality of flank parts, such as circular arcs, elliptical curves, involutes, cycloids and hyperbolic curves. Because of the complexity of these flank curves, extremely sophisticated production methods and hence very expensive tools are usually required, which often do not allow for an economical production of the rotors, in particular for small screw-type compressor units. In addition to the numerous operation steps and the various tools necessary to carry out the same, the realization of such complex profiles frequently is adversely affected by unfavorable cutting conditions so that the tools wear to an increased extent, shortening their service lives. Frequent re-grinding of the tools is necessary, which results not only in increased costs for the operation procedure as such, but also in reduced accuracy of the profile form and thus frequent calls for expensive refinishing operations.

In German Auslegeschrift No. 22 34 777 a tooth profile is described, which is comprised of involutes and circular arcs. With this arrangement, a further involute is generated on the gate rotor as the envelope of the main rotor involute associated with the cycloid. Since this involute extends beyond the pitch circle of the toothing because of the profile form of the main rotor, a relatively long involute section is generated on the gate rotor, which causes a large blow hole. The blow hole of the compressor toothing is formed because the rotor mesh along which the tooth flanks of the main and gate rotor teeth of an interengaging tooth pair meet does not extend as far as to that edge of the housing which results from the intersection of the two housing bores.

Furthermore, a relative velocity is produced on the gate-rotor head, that depends on the radius of the gate rotor, if this radius does not coincide with the radius of the pitch circle as appears from to German Auslegeschrift No. 22 34 777. This relative velocity causes scuffing and increases the leakage amounts in addition to the large blow hole, thus deteriorating the internal compressor efficiency.

In German Offenlegungsschrift No. 31 40 107 a rotor profile is proposed, in which the tooth flanks of the main rotor are not composed of curve segments, but are formed by a continuous, uniform analytically definable curve form from one crest point of the main rotor to the next one. Although this results in a very simple and robust design of the main rotor, which can be produced in a relatively simple manner, the form of the toothing of the gate rotor is markedly more complicated, which again involves production problems. Furthermore, this toothing, due to the profile form, has very small operation spaces with comparatively large clearance lengths. Despite the fact that the production of the main rotor has been simplified and thereby the toothing can be produced more accurately, relatively large leakage gaps form, which produce large leakage-gas amounts and thus lower compressor efficiencies than comparable systems.

In addition, intensive scuffing and heating during operation are to be expected, in particular with the embodiment known from German Offenlegungsschrift No. 31 40 107, which has pointed teeth on the gate rotor, whereby the leakage-gas amounts are again raised and the compressor efficiency is again lowered.

SUMMARY OF THE INVENTION

The invention aims at avoiding the above-described disadvantages and provides for a toothing for a screw-type compressor arrangement, which is characterized by ease of manufacture, a robust design and small leakage gaps both for the main and the gate rotors. In addition, low-cost manufacture by simple methods, such as hobbing, is feasible and a low-wear operation is to be ensured.

This object is achieved according to the invention in that both flanks of the main-rotor teeth are surfaces conforming to the envelope of a helical, or screwed, plane inclined with respect to the axis of the helix, and which follow a constant curve course continuously from the tooth root to the tooth crest. The shape of the flanks of the main rotor teeth, sometimes described as screwed developables, enables very simple manufacture, such as by hobbing or by planing.

With the toothing according to the invention, an involute is generated in the end cross section, which, according to the known toothing principles, produces an involute and thus a similar inclined helical plane envelope on the gate rotor, as well, which is thus manufacturable in a simple manner like the main rotor. Furthermore, a constant curve course from the tooth root to the tooth crest is provided by the toothing according to the invention. Thereby, irregularities and discontinuities in the tooth flanks and tips at the transmission of force during operation are avoided and unnecessary sliding and scuffing are prevented.

According to an advantageous embodiment of the invention, the teeth of the main rotor, in the end cross section, are designed so as to be symmetrical with respect to a partial plane containing the screw axis, the diameter of the root circle of the main rotor tooth preferably being equal to the pitch circle radius of the main rotor, and the radius of the base circle of the inclined helical plane envelope preferably being smaller than the radius of the pitch circle. A symmetrical profile form has the advantage of an identical manufacture of the two tooth flanks of both the main and the gate rotors. Choosing the pitch circle to be the root circle has the advantage that, during rolling off of the main and gate rotors, no relative velocity between the main rotor tooth root and the gate rotor tooth crest and thus no scuffing occur, which would lead to higher leakage losses and thus a poorer compressor efficiency.

Furthermore, it is advantageous if the external diameter of the gate rotor is equal to the pitch circle diameter of the gate rotor. Thereby, the main rotor and gate rotor flanks roll off each other during operation and a loss on account of the sliding of the flanks at each other is avoided.

Further in accordance with the invention, the main rotor comprises at least three teeth and the gate rotor comprises at least four teeth. According to a preferred embodiment, the combination main rotor teeth $Z1=4$ and gate rotor teeth $Z2=5$ or 6 affords the optimum geometry and the most favorable operation and rolling characteristics.

In a particularly favorable realization of the profile according to the invention, the main rotor teeth are asymmetrical in the end cross section with respect to a partial plane containing the screw axis and the radius of the base circle of the suction-side inclined helical plane envelope of the main rotor tooth, which is in engagement with the gate rotor is smaller than the radius of the base circle of the pressure-side inclined helical plane envelope of the main rotor tooth, which is in engagement with the gate rotor.

Furthermore, it has proved advantageous if, according to the invention, the radius of the base circle of the pressure-side inclined helical plane envelope is equal to the pitch radius of the main rotor, and the two unequal inclined helical plane envelopes of the asymmetrical profile come to lie in a manner that, in the end cross section, the two involutes intersect in a point located on the external diameter of the main rotor.

According to the invention, an asymmetrical main rotor tooth thus results with which, in the end cross section, the suction-side involute is designed to be longer than the pressure-side involute. Hence follows, it that the gate rotor involute, which is in engagement with the pressure-side main rotor involute, in the end cross section, is designed to be very short, so that the pressure-side blow hole resulting from the geometry is reduced to almost zero. Thereby, the leakage flows through this blow hole get negligibly small, thus improving the compressor efficiency as compared to known embodiments.

In addition, excellent cinematic rolling conditions are attained on account of the rolling of the main rotor and gate rotor pitch circles as well as on account of the small relative speeds prevailing between the main rotor and gate rotor flanks, which affords little scuffing and thus a long service life of the rotors as well as little losses.

According to the invention, it is also possible to increase the accuracy of manufacture and to render the rotor production cheaper. Thus, a screw-type compressor arranged according to the invention has become substantially cheaper than arrangements available on the market, both in terms of operation and in terms of manufacture.

Moreover, it is advantageous for the profile according to the invention that, due to a correction of the axial distance, the main rotor involutes, in the end cross section, meet the gate-rotor involutes in two points in the zero position, thus providing a three-point contact of the toothing in the zero position.

The zero position of the toothing is defined by the position of the rotor at the compression or discharge end. If, in that position, there is no contact of the main rotor and gate rotor flanks in three points, the toothing is not tight in that position and an additional leakage gap forms, causing the leakage of gas masses and thus a poorer efficiency.

With known screw-type compressor toothings, such as, for instance, according to German Auslegeschrift No. 22 34 777, such a three-point contact is formed by a very complex profile composed of circular arcs, involutes, cycloids, etc. In addition to very expensive and cumbersome manufacture, this causes sliding of the main rotor and gate rotor flanks on each other during operation, which results in scuffing on these curve sections and thus in losses. On the other hand the profile described in German Offenlegungsschrift No. 31 40 107 does not allow for an exact three-point contact.

With the profile according to the invention, simple and cheap manufacturing is enabled, and the surfaces roll off each other even after a correction of the axial distance, thereby ensuring improved operation.

According to a preferred embodiment, utilizing the asymmetrical profile the inner wall of the housing of the gate rotor can also serve as a bearing bush for the gate rotor. Thereby one can do without an expensive bearing construction for the gate rotor.

Usually, with screw-type compressors, only about 10% of the main rotor torque is transmitted onto the gate rotor during operation. Hence relative low bearing forces occur for the gate rotor, which can easily be accommodated by the wide gate rotor tooth crests existing with the asymmetrical profile of the invention, the tooth crests being formed by circular arcs identical with the housing bore.

This form of construction of the invention, furthermore, is advantageous in that the assembly is very sturdy and allows for practically no bending of the gate rotor. Thus, sliding of the gate rotor teeth on the housing bore is prevented on the one hand and no enlargement of the leakage gaps by bending occurs during operation on the other hand, so that the internal compressor efficiency is improved. The lubrication of the bearing places is ensured by oil injection during compression at any time.

If the design of the main and gate rotors is appropriately robust, the drive of the rotary piston compressor suitably may be effected via the gate rotor. With known screw-type compressor plants, however, driving by the gate rotor is possible only in the most rare cases and the poor force transmission angle between main rotor and gate rotor results in increased wear and scuffing during operation. With the toothing according to the invention it is, however, possible to freely choose the force transmission angle prior to designing the toothing because of the constant engagement angle existing with involute toothings and favorable transmission angles thus are attainable. In particular, because of the usually larger number of gate rotor teeth, drive of the gate rotor has the advantage that the circumferential speed of the rotor pair becomes larger and thus the leakage amounts per unit of compressed gas become smaller. This is positively reflected by the specific performance required and by the internal compressor efficiency.

As a result of the toothing designed according to the invention, the pitches of the main rotor and gate rotor helices may be freely chosen. Depending on the pitch selected, this enables very short, robust and cheap rotors characterized by little bending as compared to known rotors.

Furthermore, the toothing of the invention has advantages even at an interrupted operation of screw-type compressors, because, due to the freely choosable favorable angle of force transmission, the impacts at each starting of the compressor can be easily accommodated and increased wear can thus be prevented.

BRIEF DESCRIPTION OF THE DRAWINGS

Further details of the invention will be explained by way of the embodiments schematically illustrated in FIGS. 1 to 8, wherein.

DETAILED DESCRIPTION OF THE INVENTION

Figure 1:
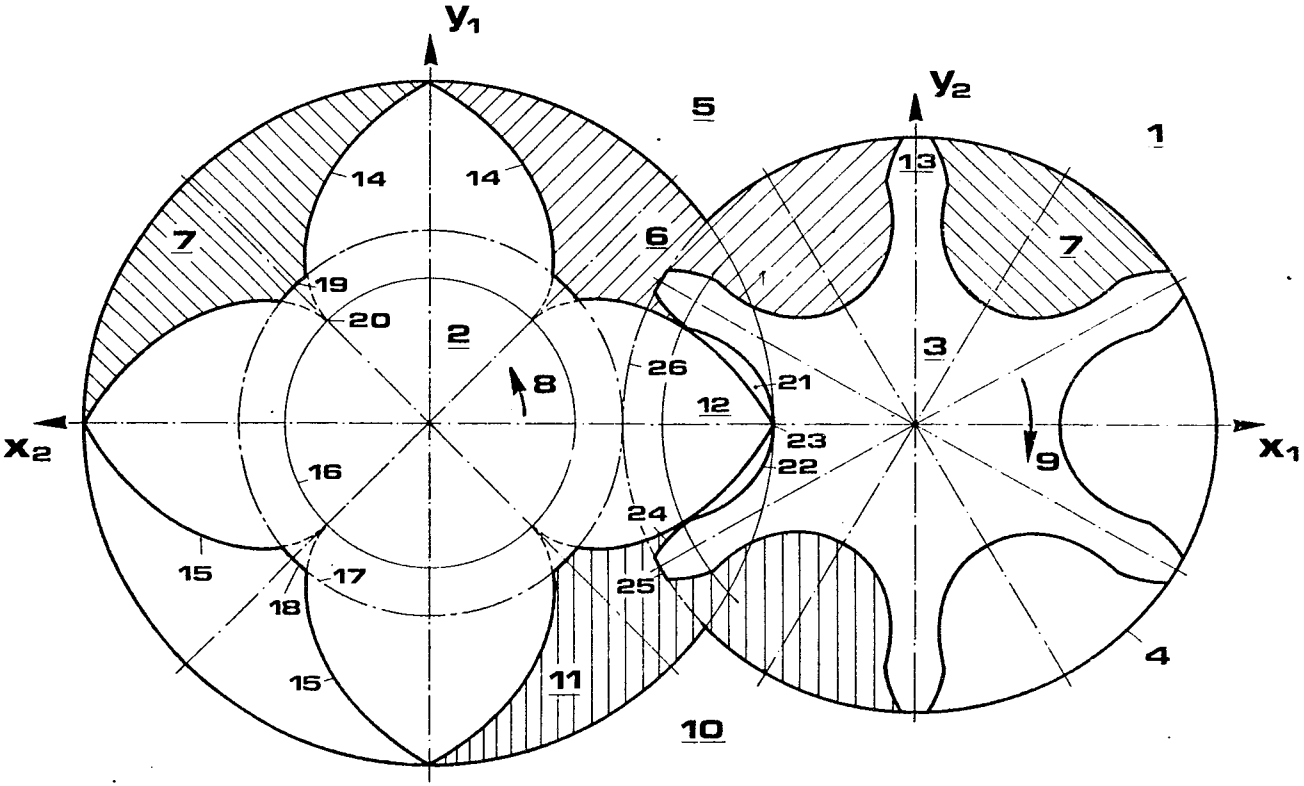
FIG. 1 shows the engagement of a main rotor in the tooth space of a gate rotor with a symmetrical profile design in the zero position, in the end cross section.

In FIG. 1, the end cross section of a screw-type compressor arrangement 1 comprising a main rotor 2 and a gate rotor 3 is schematically illustrated in a compressor housing 4. The rotors 2, 3, which are in meshing engagement with each other, are shown in the zero position as usual, seen from the pressure-side end of the compressor arrangement 1, i.e. on the discharge end.

The gas to be compressed is sucked into the screw-type compressor arrangement 1 on the suction side 5 axially opposite the end cross section of FIG. 1 and, after closure of the compressor chambers 6 and 7 by turning the main rotor 2 into the direction of the arrow 8 and thereby turning the gate rotor 3 into the direction of the arrow 9, the gas reaches the pressure side 10, wherein it is compressed by a reduction of the compression chamber 11 and, after having reached the final pressure of compression, is connected with the pressure pipe in the housing 4 by a discharge port (not illustrated).

In FIG. 1, the main rotor 2 comprises four teeth 12, whereas the gate rotor 3 has six teeth 13. The flanks of each of the main rotor teeth 12 are each formed by two symmetrically disposed inclined helical plane envelopes 14, which result in pointed circular involutes 15 in the end cross section. The base circle of this circular involute is denoted by 16, the radius of the base circle being smaller than the radius of the pitch circle 17 of the main rotor. According to the profile design of the invention, the surface 14 ends on the cylinder surface 18, which is determined by the radius of the pitch circle 17 of the main rotor. Thus in the end cross section of FIG. 1 of the screw-type compressor arrangement 1 according to the invention, a short circular arc segment 19 between the sections of the circular involutes 15, eliminating the effectively unmanufacturable dotted line portion 20 of the profile from the rotor.

The gate rotor tooth space 21 pertaining to the main rotor 12 is formed by the point path 22 of the main rotor tooth tip 23 as well as by the envelope path 24 of the main rotor flank 14, the point path 22 representing an entwined cycloid and the envelope path 24 representing an involute in the end cross section, according to known toothing principles. The gate rotor tooth is delimited by a circular arc piece 25 on the external diameter, the radius of this circular arc piece 25 equalling the radius of the gate rotor pitch circle 26.

Figure 2:
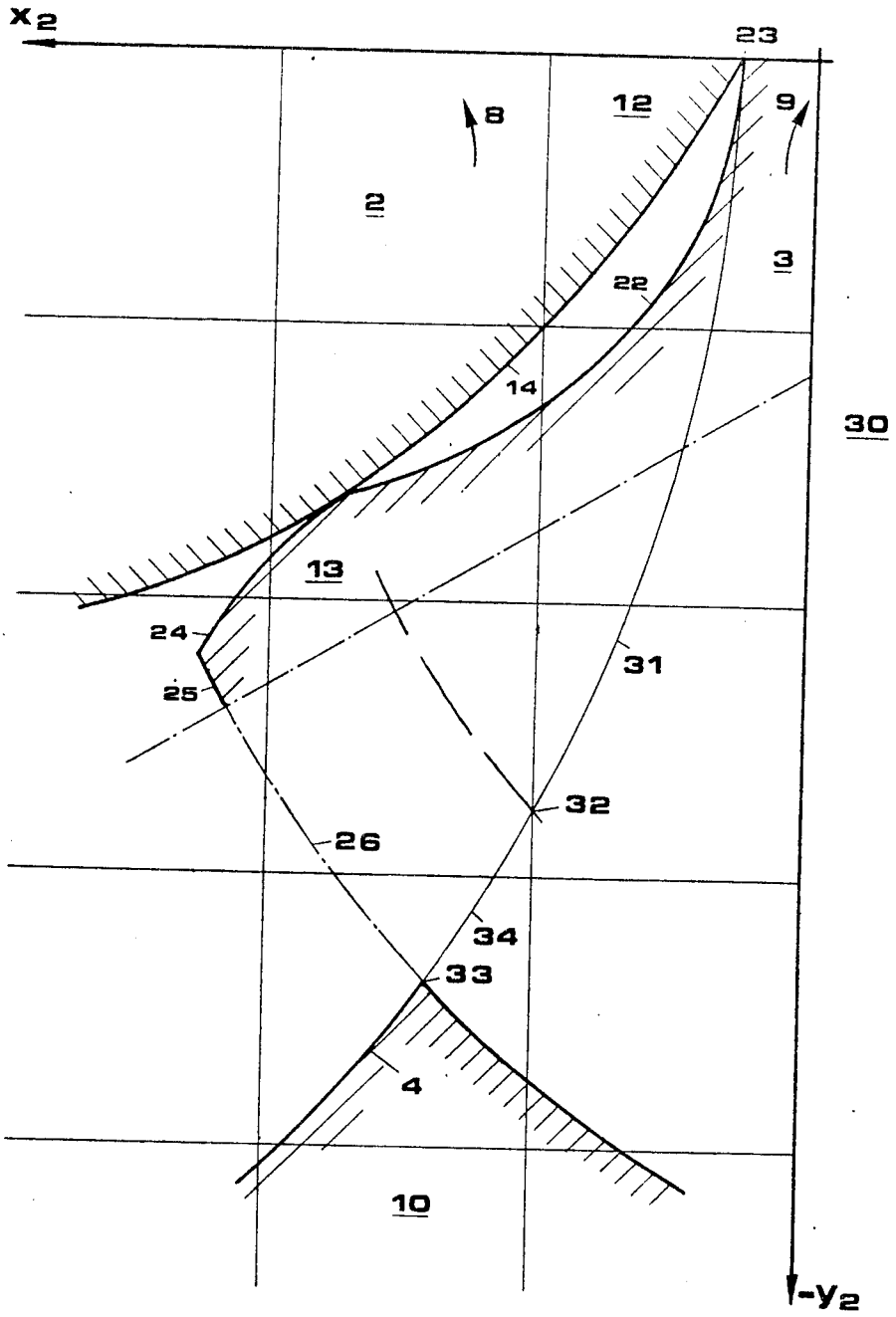
FIG. 2 is an enlarged sectional view of the engagement according to FIG. 1.

FIG. 2 is an enlarged section of the rotor pair 2, 3 having the symmetrical profile according to the invention and being in meshing interengagement. Again, the main rotor is denoted by 2, the gate rotor by 3, the schematic housing by 4, the main rotor flank by 14, the gate rotor cycloid by 22, the gate rotor involute by 24 and the gate circular arc of the rotor by 25.

When turning the main rotor 2 opposite the direction of the arrow 8, the main rotor tip 23 migrates in a static reference system 30 along the circular arc 31, the main rotor tip 23 being in engagement with the gate rotor cycloid 22 as far as to the point 32. The pressure-side blow hole, which is a geometrically caused leakage area, is formed between the last engagement point 32 of the main rotor tip 23 with the gate rotor cycloid 22 and the section of the housing bore 33. From the arc length 34 in FIG. 2 it is apparent that, with the symmetrical screw-type-compressor toothing according to the invention, the blow hole area becomes small so that but small leakage gas amounts can flow off through the blow hole.

Figure 3:
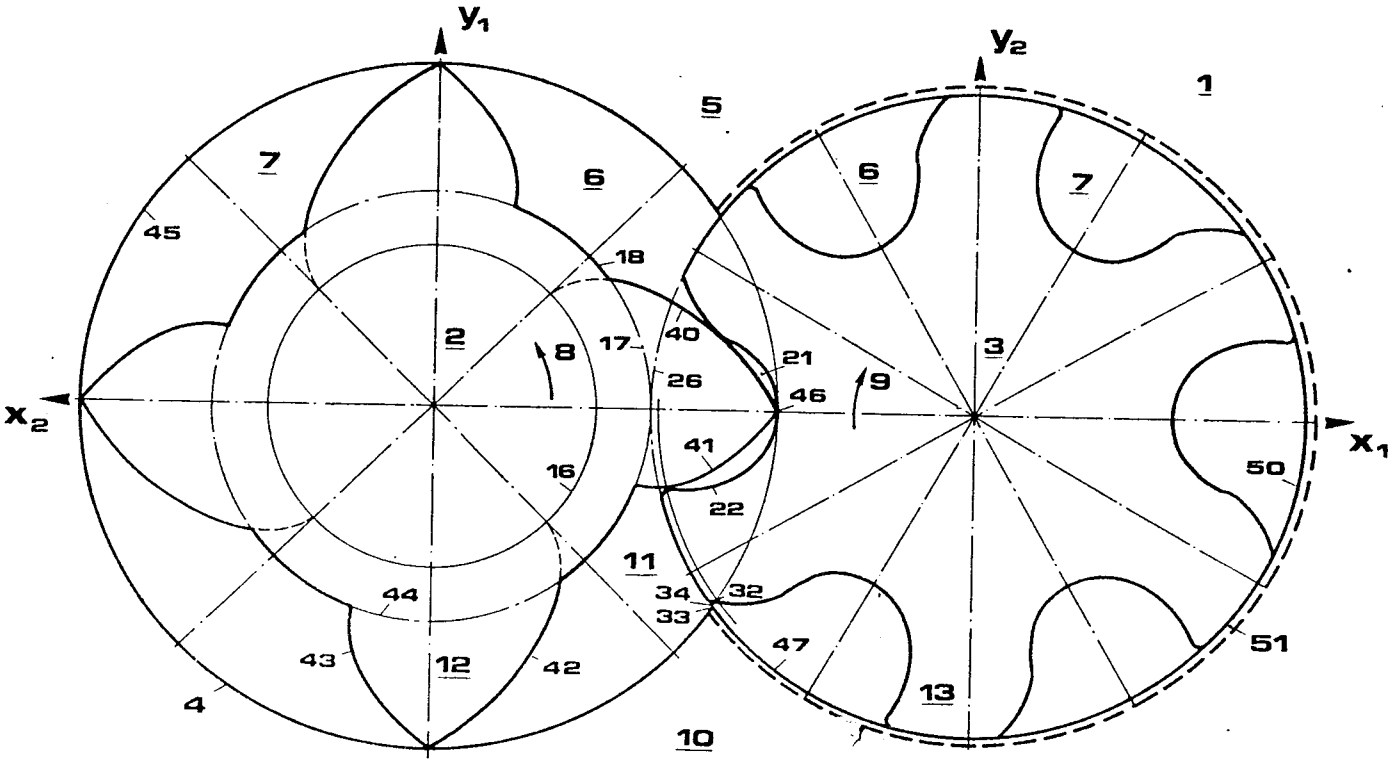
FIG. 3 shows the engagement with an asymmetrical profile in the end cross section, also in the zero position.

FIG. 3 is an end cross section similar to FIG. 1, of a screw-type compressor arrangement 1, but illustrating the asymmetrical flank profile of the invention. In FIG. 3 the same machine parts have been denoted by the same numerals as in FIGS. 1 and 2. With an asymmetrical profile, each main rotor tooth 12 has flanks 40, 41, each in the form of an inclined helical plane envelope, which generate pointed circular involutes 42 and 43, respectively, in the end cross section. With the profile according to the invention, only one branch each of the flanks 40 and 41 and of the pointed circular involutes 42, 43, respectively, is used. The base circle 16 of the envelope of the flank 40, which is on the suction-side of the main rotor tooth 12 being in engagement with the gate rotor space 21, has a radius that is smaller than the pitch circle 17 of the main rotor. However, the flank 40 again extends only as far as to the cylinder 18 formed by the radius of the pitch circle 17. On the other hand the envelope of the flank 41 has a pitch circle radius 44 that is larger than the pitch circle radius 16 of the screwed developable 40 and, preferably, equals the radius of the pitch circle 17 of the main rotor.

In this case, the flank 41 is formed in a manner that the two flanks 40 and 41 taper to meet on a predetermined external diameter 45 to form a tip 46. By the asymmetrical arrangement of the envelopes of the flanks 40, 41, according to the invention, it can be achieved that the gate rotor cycloid 22, on the pressure-side of the interengaged tooth pair, extends almost as far as the gate rotor radius 47, which, preferably is equal to the radius of the gate rotor pitch circle 26. As is apparent from FIG. 3, the blow hole path 34 between the last engagement point 32 and the housing point of intersection 33 thereby may be further reduced, the blow hole area and thus the leakage amounts through this geometrically caused clearance becoming negligibly small.

Figure 4:
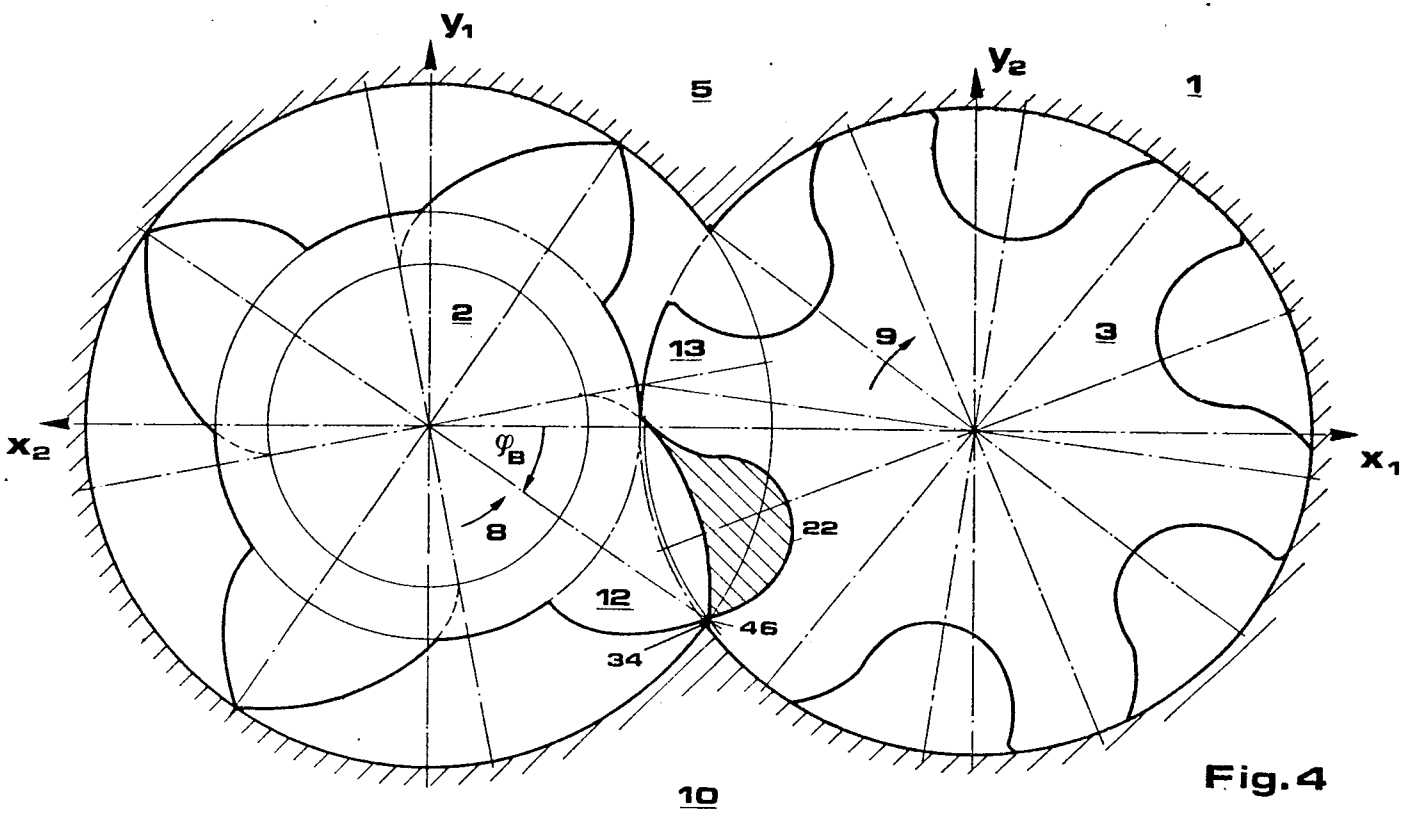
FIG. 4 is a turned rotor position with an asymmetrical profile design, the main rotor having been rotated from the starting position by a blow angle $\phi_B$.
Figure 5:
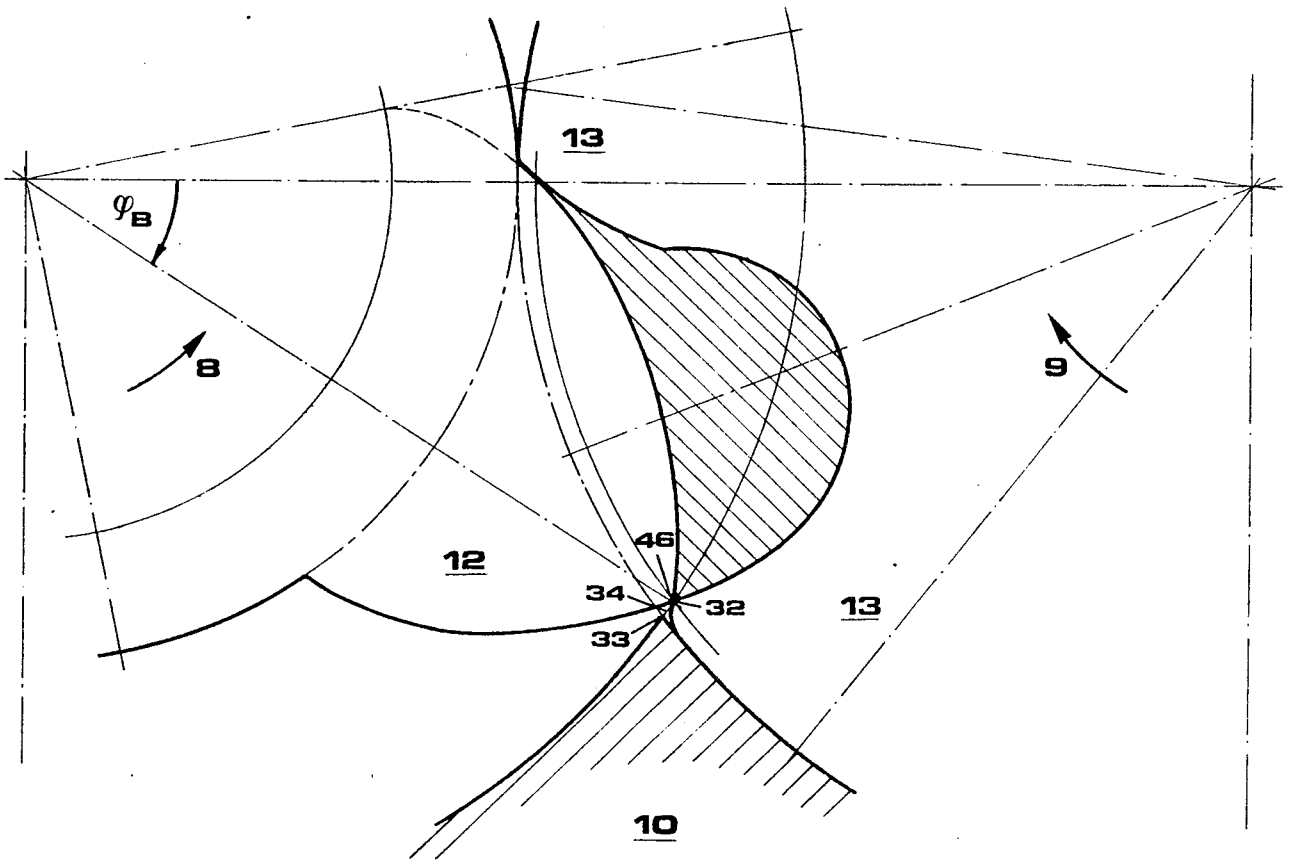
FIG. 5 is an enlarged view of the engagement according to FIG. 4.

In FIG. 4, a rotated position of the rotor pair 2, 3 is illustrated in which the main rotor tip 46 for the first time contacts the gate rotor cycloid 22, as the main rotor is turned into the direction of the arrow 8, thus having just passed the blow hole path 34. Even from this representation and from the enlarged view of FIG. 5, the small blow hole area is recognizable.

Figure 6:
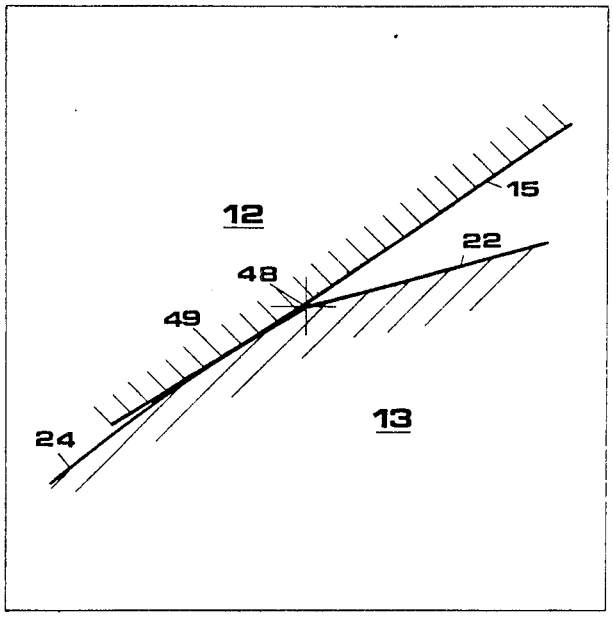
FIG. 6 is a 40 times enlargement of the engagement of the symmetrical profile according to FIG. 1, with the appropriate axial distance correction for a three-point contact in the zero position.

In FIG. 6 an enlarged section of the toothing engagement of the symmetrical profile embodiment, corrected with respect to the axial distance, is shown. The drawing demonstrates that it is possible to attain an exact three-point contact in the zero position by a correction of the axial distance, which is necessary for a reduction of the leakage gaps without deteriorating the running or rolling characteristics of the toothing. In FIG. 6 the point of intersection between the gate rotor cycloid 22 and the gate rotor involute 24 is denoted by 48 and the point of contact between the main rotor flank 15 and the gate rotor involute 24 is denoted by 49.

In the end cross section, i.e., in a plane perpendicular to the axis of the rotor, each of the flanks is in the form of an involute and the involute curves of the two flanks meet in a point, i.e., 23 in FIG. 1 and 46 in FIG. 3. In meshing with the gate rotor concave groove, the space between the main rotor tooth flank and the concave wall of the gate rotor groove, in the direction of rotation of the main rotor, is the compression side, whereas the space between the main rotor flank and the other side of the gate rotor groove is the suction side. This is consistent with conventional compressor terminology. In this regard, the reference to "zero position" refers to the desired arrangement wherein the main rotor tooth engages the gate rotor tooth space in three-point contact, that is, the tip of the main rotor tooth and the two flanks engage three distinct points in the gate rotor groove.

Furthermore, a gate rotor mounted according to the invention has been illustrated in FIG. 3. To this end, a bearing bush 51 has been inserted into the housing bore 50 of the gate rotor by surface welding with an UTB bronze electrode, the Brinell hardness of the bronze being adjustable in a known manner by the current strength during surface welding. By using a naturally hard gate rotor 3 to mesh with a hardened main rotor 2 and by using a naturally hard housing to accomodate the hardened bearing bronze 51, excellent mounting and running conditions may be achieved.

Figure 7:
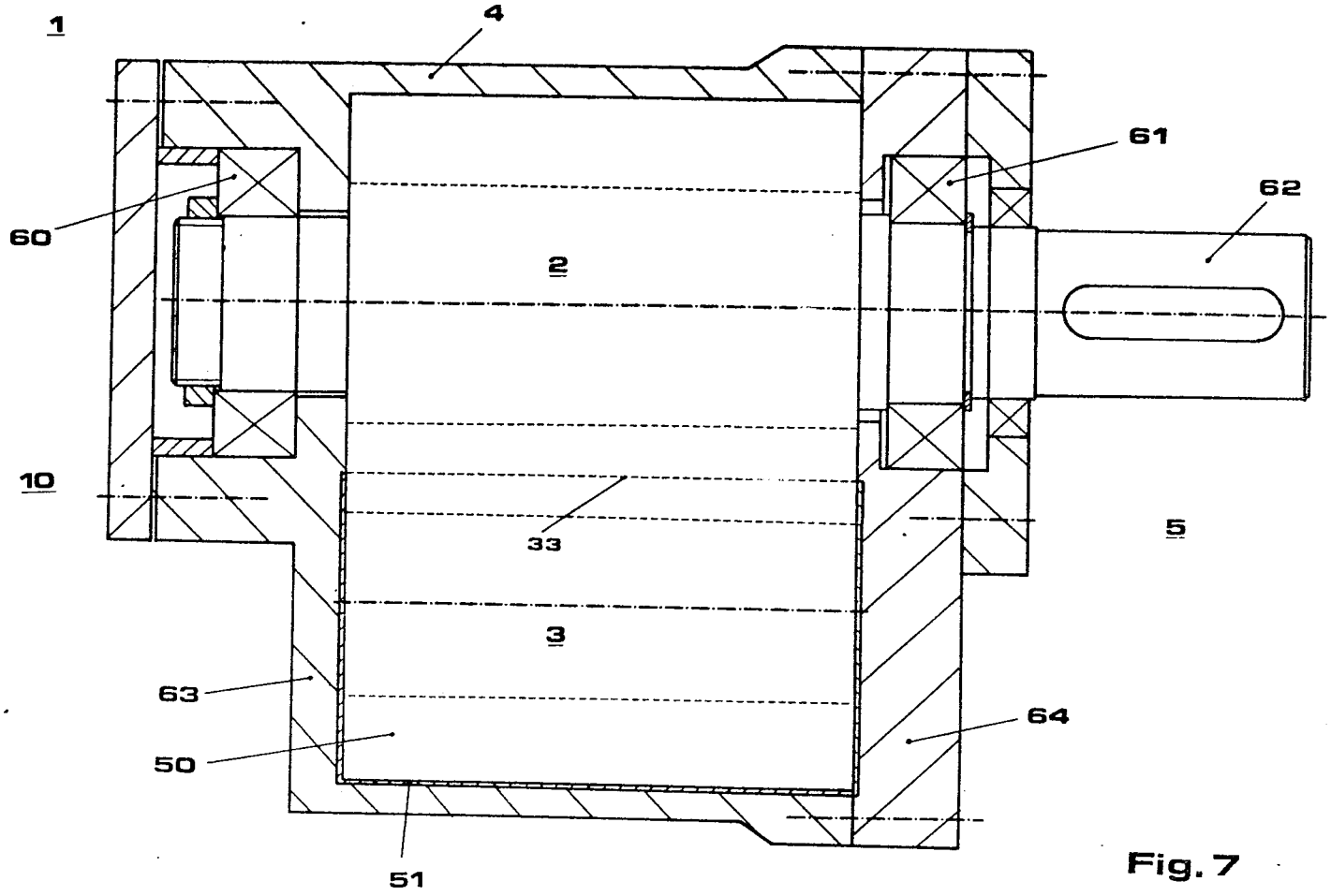
FIG. 7 is a schematic longitudinal section through a rotary piston compressor according to the invention, with which the housing bore of the gate rotor is designed as a bearing bush for the gate rotor.

In FIG. 7 a schematic longitudinal section through a screw-type compressor arrangement 1 according to the invention is illustrated. The main rotor 2, in a known manner, is rotatably mounted in the housing 4 such that the fixed bearing 60 is disposed on the pressure side 10 and the expansion bearing 61 is on the suction side 5 of the screw-type compressor arrangement 1. Driving of the arrangement 1 is effected via a coupling (not illustrated) provided on the suction-side shaft end 62 of the main rotor 2.

The mounting of the gate rotor 3 is realized in a bearing bush 51 inserted in the housing bore 50 by surface welding, which bearing bush 51 is arranged both on the pressure-side housing end face 63 and in the suction-side housing lid 64 as far as to the section edge 33 of the housing bore.

Figure 8:
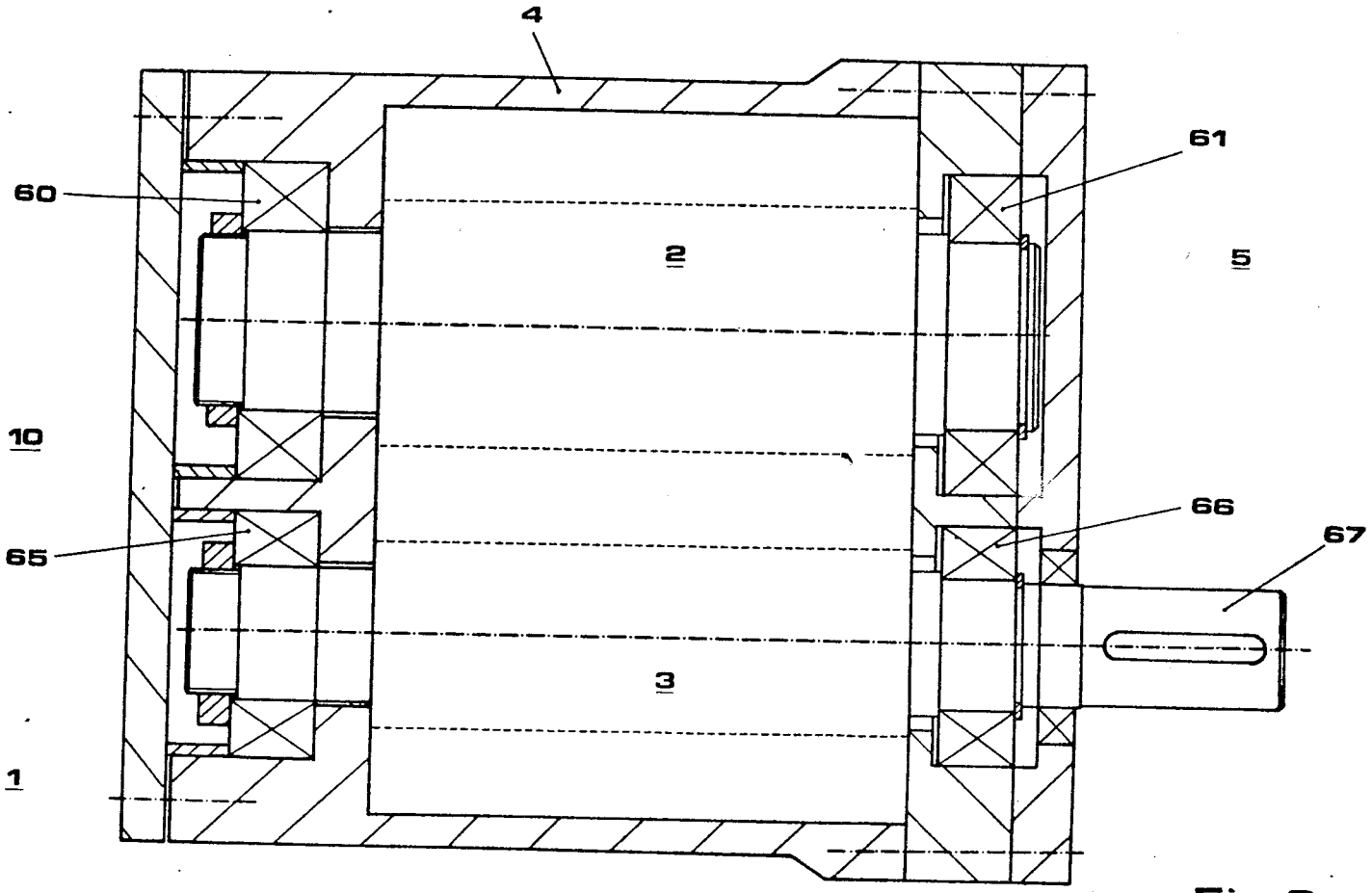
FIG. 8 is a schematic longitudinal section through a rotary piston compressor with gate rotor drive.

In FIG. 8 a longitudinal section through a further screw-type compressor plant 1 according to the invention is schematically illustrated, wherein the main rotor 2 is rotatably mounted in the housing 4 in a pressure-side fixed bearing 60 and a suction-side expansion bearing 61.

With this embodiment, the gate rotor 3 likewisely is rotatably mounted in a pressure-side fixed bearing 65 and a suction-side expansion bearing 66. With this embodiment shown, driving of the arrangement 1 is effected via a coupling (not illustrated), which is flanged to the suction-side shaft end 67 of the gate rotor 3. The drive torque is transmitted to the main rotor 2 via the gate rotor teeth 13, the aspirated gas being compressed in the tooth spaces and pushed out on the pressure side 10 into a pressure tank (not illustrated).

What I claim is:

1. In a parallel axis rotary piston compressor arrangement of the type including a housing accommodating at least two rotor means, said rotor means including a main rotor and a gate rotor edged with tooth spaces extending in a screw-like manner, said main rotor and said gate rotor being arranged to interengage each other with their axes parallel, each of said rotors having a pitch circle, said main rotor including main rotor teeth each having two tooth flanks designed to be substantially convex and located outside of the main rotor pitch circle and said gate rotor including gate rotor teeth having tooth flanks designed to be substantially concave and located within the gate rotor pitch circle, each of said main rotor teeth and said gate rotor teeth having a tooth root and a tooth crest, the improvement wherein each of the two tooth flanks of each of said main rotor teeth comprises a surface conforming to the envelope of a helical plane inclined with respect to the axis thereof and which follows a constant curve course continuously from said tooth root to said tooth crest, adjacent tooth flanks following said constant curve course from the crest of one tooth flank to the root of the corresponding tooth and from the root of the next adjacent tooth to the crest thereof.

2. A rotary piston compressor arrangement as set forth in claim 1, wherein driving of said arrangement is effected via said gate rotor.

3. A rotary piston compressor arrangement as set forth in claim 1, wherein said main rotor comprises at least three teeth and said gate rotor comprises at least four teeth.

4. A rotary piston compressor arrangement as set forth in claim 3, wherein said main rotor comprises four teeth and said gate rotor comprises six teeth.

5. A rotary piston compressor arrangement as set forth in claim 1, wherein each of said main rotor teeth is symmetrical in its end cross-section with respect to a plane including the axis of said main rotor and extending radially therefrom.

6. A rotary piston compressor arrangement as set forth in claim 5, wherein each of said main rotor teeth has a root circle radius that is equal to its pitch circle radius.

7. A rotary piston compressor arrangement as set forth in claim 5, wherein said tooth flank surface has a base circle radius that is smaller than said main rotor pitch circle radius.

8. A rotary piston compressor arrangement as set forth in claim 5, wherein the gate rotor has an external diameter that is equal to the diameter of the pitch circle of said gate rotor.

9. A rotary piston compressor arrangement as set forth in claim 1, wherein each of said main rotor teeth is asymmetrical in its end cross-section with respect to a plane including the axis of said main rotor and extending radially therefrom, and each main rotor tooth in engagement with said gate rotor comprises a suction-side tooth flank surface and a pressure-side tooth flank surface, said suction-side tooth flank surface having a base circle radius that is smaller than the base circle radius of said pressure-side tooth flank surface.

10. A rotary piston compressor arrangement as set forth in claim 8, wherein said housing includes a portion having an inner wall providing a bearing bush for said gate rotor.

11. A rotary piston compressor arrangement as set forth in claim 8, in which the asymmetrical tooth flank surfaces generate involutes at their intersections with the plane of said end cross-section, and wherein the base circle radius of the pressure-side tooth flank surface is equal to the pitch circle radius of said main rotor and said involutes, in said end cross section, intersect at a point located on the external circumference of said main rotor.

12. A rotary piston compressor arrangement as set forth in claim 9 wherein the tooth flank surfaces of said gate rotor generate involutes at their intersections with the plane of said end cross-section and wherein said involutes generated by the tooth flank surfaces of said main rotor teeth contact the involutes generated by the tooth flank surfaces of said gate rotor at two points at a relative rotational position of said main and gate rotors, the point of intersection of said main rotor tooth involutes also contacting said gate rotor tooth space at the same time, thereby to provide three point contact between said main rotor tooth and said gate rotor tooth space at said relative rotational position.

* * * * *

UNITED STATES PATENT AND TRADEMARK OFFICE

CERTIFICATE OF CORRECTION

PATENT NO. : 4,614,484

DATED : September 30, 1986

INVENTOR(S) : Gerold Riegler

It is certified that error appears in the above-identified patent and that said Letters Patent is hereby corrected as shown below:

Col. 1, line 41, "dislodge" should read --discharge--; line 53, "effeciency" should read --efficiency--; line 66, after "incompressibility" insert -- . This also--. Col. 2, line 1, delete "the". Col. 4, line 22, "follows, it" should read -- , it follows--. Col. 6, line 5, "$\phi_B$" should read --$\varphi_B$--; line 53, after "19" insert --is formed--. Col. 7, line 36, delete "to"; bridging lines 39-40, "screwed developable" should read --envelope of the flank--. Col. 10, line 20, "claim 8" should read --claim 9--; line 24, "claim 8" should read --claim 9--; and line 33, "claim 9" should read --claim 11--.

Signed and Sealed this

Thirtieth Day of December, 1986

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,614,484

DATED : September 30, 1986

INVENTOR(S) : Gerold Riegler

It is certified that error appears in the above-identified patent and that said Letters Patent is hereby corrected as shown below:

Column 1, line 64, after "increases" insert --in--.

Signed and Sealed this

Twenty-fourth Day of February, 1987

*Attest:*

DONALD J. QUIGG

*Attesting Officer* *Commissioner of Patents and Trademarks*